US006931988B1

(12) United States Patent
Sherf

(10) Patent No.: US 6,931,988 B1
(45) Date of Patent: Aug. 23, 2005

(54) ROTARY HEAD PAD PRINTER

(75) Inventor: Gregory A. Sherf, Roscoe, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 10/783,869

(22) Filed: Feb. 20, 2004

(51) Int. Cl.[7] ..... B41F 17/34
(52) U.S. Cl. ..... 101/41; 101/163
(58) Field of Search ..... 101/35, 41, 42, 101/43, 44, 163, 167, 169, 170, 492, 493, 101/DIG. 40

(56) References Cited

U.S. PATENT DOCUMENTS

| | | | | |
|---|---|---|---|---|
| 3,916,784 A | * | 11/1975 | Dubuit | 101/41 |
| 4,060,031 A | * | 11/1977 | Philipp | 101/163 |
| 4,530,286 A | * | 7/1985 | Samuels | 101/395 |
| 5,383,398 A | | 1/1995 | Binnen | |
| 5,476,040 A | | 12/1995 | Kleist | |
| 5,694,839 A | | 12/1997 | Wohl et al. | |
| 5,694,847 A | | 12/1997 | Kleist | |
| 5,943,957 A | * | 8/1999 | Mason | 101/483 |
| 6,276,266 B1 | | 8/2001 | Dietz | |
| 6,796,241 B2 | * | 9/2004 | Catalan et al. | 101/492 |

FOREIGN PATENT DOCUMENTS

| | | | | |
|---|---|---|---|---|
| DE | 31 30 174 A1 | * | 8/1982 | 101/41 |
| JP | 59-202856 | * | 11/1984 | |
| JP | 10-278226 | * | 10/1998 | |
| JP | 2000-94639 | * | 4/2000 | |

* cited by examiner

*Primary Examiner*—Leslie J. Evanisko
(74) *Attorney, Agent, or Firm*—Mark W. Croll, Esq.; Donald J. Breh, Esq.; Welsh & Katz, Ltd.

(57) ABSTRACT

A rotary head pad printer includes a frame, a head mounted to the frame for rotational movement on the frame so as to define a plane and at least one pad assembly mounted to the head. The pad assembly reciprocates between an extended position and a retracted position. The pad assembly rotates about an axis between a first rotational position and a second rotational position. The assembly reciprocates between the extended and retracted positions at the first and second rotational positions. The first and second rotational positions are non-parallel to one another.

17 Claims, 3 Drawing Sheets

FIG. 1C
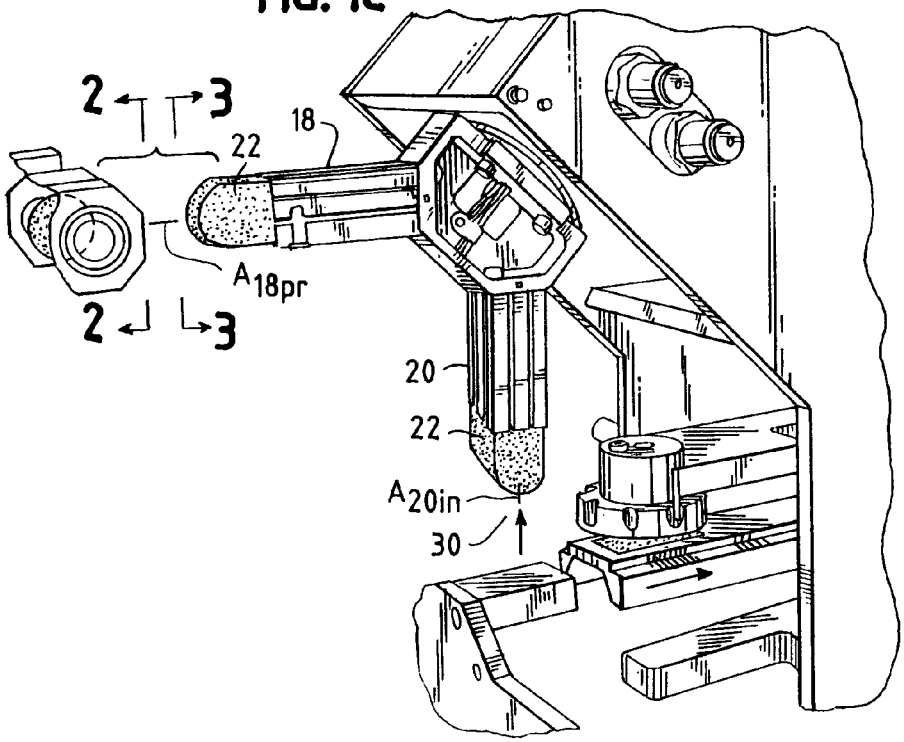
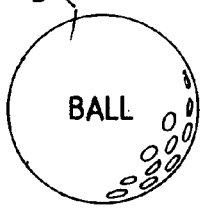
FIG. 2
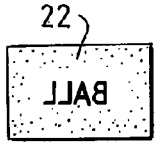
FIG. 3
FIG. 1D
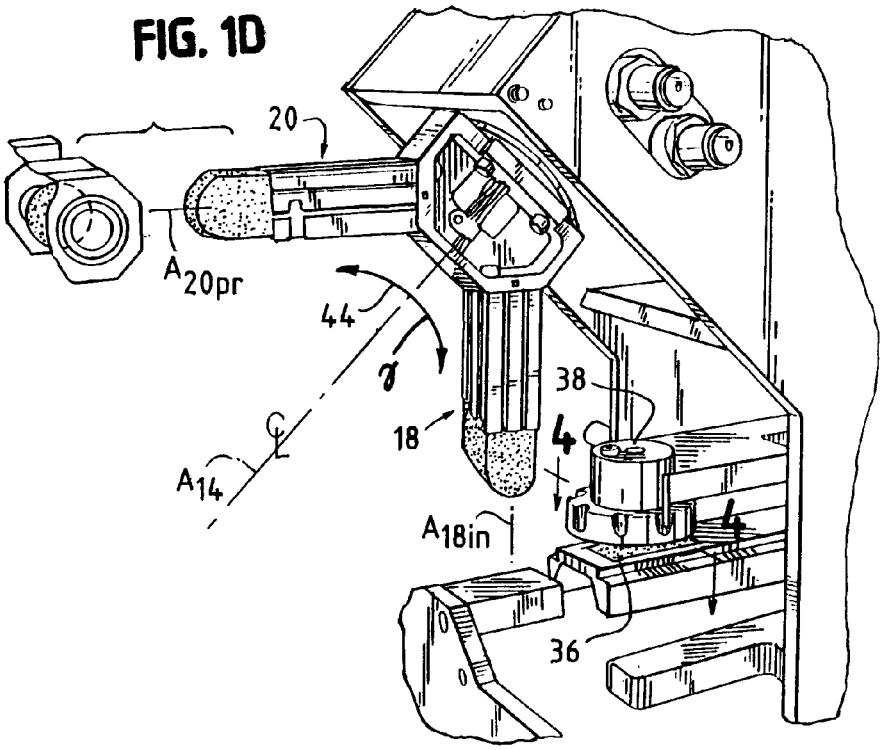
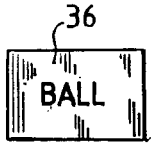
FIG. 4

ROTARY HEAD PAD PRINTER

BACKGROUND OF THE INVENTION

The present invention relates to pad printers. More particularly, the present invention relates to a versatile pad printing system.

Pad printing systems are used to apply high quality print, e.g. indicia, on non-flat surfaces. For example, pad printing systems can be used to print logos and the like on game balls such as golf balls. It will be appreciated that such printing must be carried out, not only on a spherical surface, but on a surface that is formed with dimples as well.

Conventional pad printing systems use a deformable pad which receives ink, transferred as an image, from a flat cliche plate. The plate has an etching or engraving of the indicia formed therein. Ink is transferred from an ink supply to the plate, and fills into the etched areas. The deformable pad is then pressed onto the plate and the ink is picked up by the pad. The image is then transferred to the curved surface which is to be printed. To re-ink the pad, in a commonly used arrangement, an inverted cup containing a quantity of printing ink is used to supply ink to the cliche plate. To apply a new coating of ink to the cliche plate, the ink cup and plate are moved relative to each other following each ink transfer operation.

Typically, the printing operation includes a variety of stations through which the pad is indexed, including a cleaning station, the ink transfer station and the printing station.

For the most part, pad printing is a very efficient method for printing images on spherical or other curved items. There are, however, several drawbacks to known pad printing systems. In conventional systems, the pads are mounted to a turret-like structure to move the pad between the various stations to pick up ink from the cliche plate, transfer ink to the printed item and clean the pad. The turret or pad support moves in one direction (as do the pads) as the pads are moved through the various stations. That is, the pads may all move in a (typically) vertical manner to pick up ink, transfer ink to the object (i.e., print) and clean the pad. In addition to the unidirectional movement of the turret and pads, in order to preclude complex designs, vis-a-vis extended movement of the pads or the printed objects, the cliché plates, cleaning stations and printed objects generally lie within the same horizontal plane as one another. That is, all of the movements are uniaxial and are generally within the same horizontal plane.

While the printing operation itself functions well, integration of the printing operation into an overall process can be difficult. This is due to the limited space that may be available to, for example, integrate a conveyor system for the objects to be printed into the overall operating scheme.

Accordingly, there is a need for a printing system that includes pads that move in non-parallel axes. More desirably, such a printing system is configured such that the ink is transferred from the cliche plate to the pad in a horizontal plane that is not required to be that same as the horizontal plane in which the ink is transferred from the pad to the printed object.

SUMMARY OF THE INVENTION

A rotary head pad printer includes a frame, a head mounted to the frame for rotational movement on the frame, and at least one, and preferably a pair, of pad assemblies mounted to the head. The pad assemblies each reciprocate between an extended position and a retracted position. The pad assemblies are rotatable about an axis between a first position and a second position. Each assembly reciprocates between the extended and retracted positions at the first and second rotational positions independently of the other. The first and second rotational positions are non-parallel to one another. The assemblies rotate 180 degrees between the first and second positions.

These and other features and advantages of the present invention will be readily apparent from the following detailed description, in conjunction with the claims.

BRIEF DESCRIPTION OF THE DRAWINGS

The benefits and advantages of the present invention will become more readily apparent to those of ordinary skill in the relevant art after reviewing the following detailed description and accompanying drawings, wherein:

FIG. 1C is a perspective view of the printer showing both assemblies in their retracted positions;

FIG. 1D is a perspective view of the printer showing the assemblies in the retracted positions and illustrating rotation of the turret to move the assemblies (pads) to their next indexed station;

FIG. 2 is a view of a printed golf ball as seen from the perspective taken along line 2—2 in FIG. 1C;

FIG. 3 is a view of the inked pad as seen from the perspective taken along line 3—3 in FIG. 1C;

FIG. 4 is a view of the cliche plate as seen from the perspective taken along line 4—4 in FIG. 1D;

DETAILED DESCRIPTION OF THE INVENTION

Figure 1A:
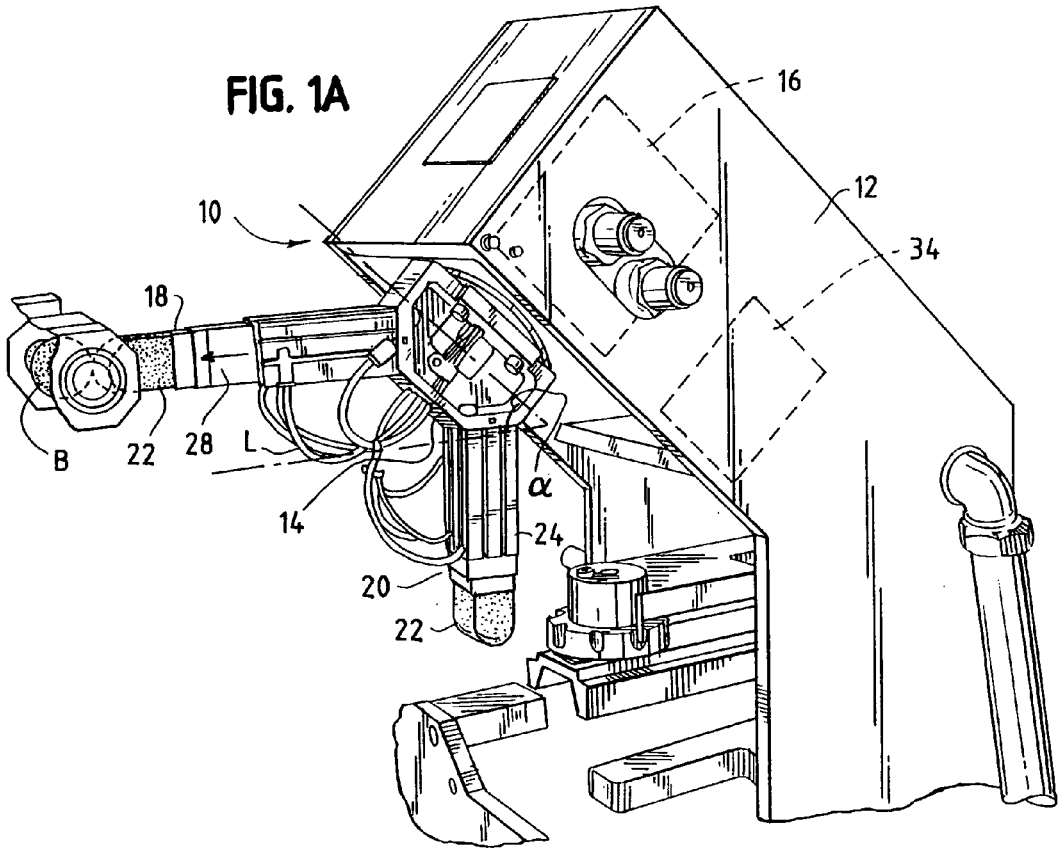
FIG. 1A is a perspective view of a rotary head pad printer embodying the principles of the present invention, the printer having two pad assemblies mounted thereto, one assembly being shown in an extended printing position to bring the pad into contact with a ball to print on the ball, and the other assembly being illustrated in a retracted inking position.
Figure 1B:
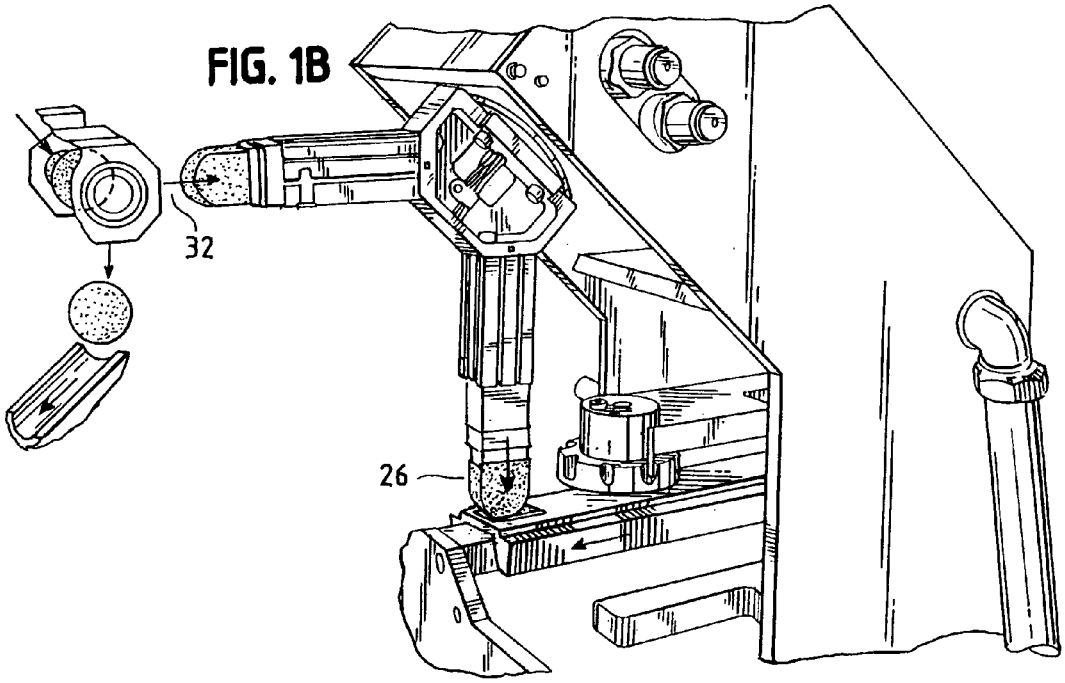
FIG. 1B is a perspective view of the printer with one assembly in the retracted printing position and the other assembly in the extended inking position for picking up ink from the cliche plate.
Figure 5A:
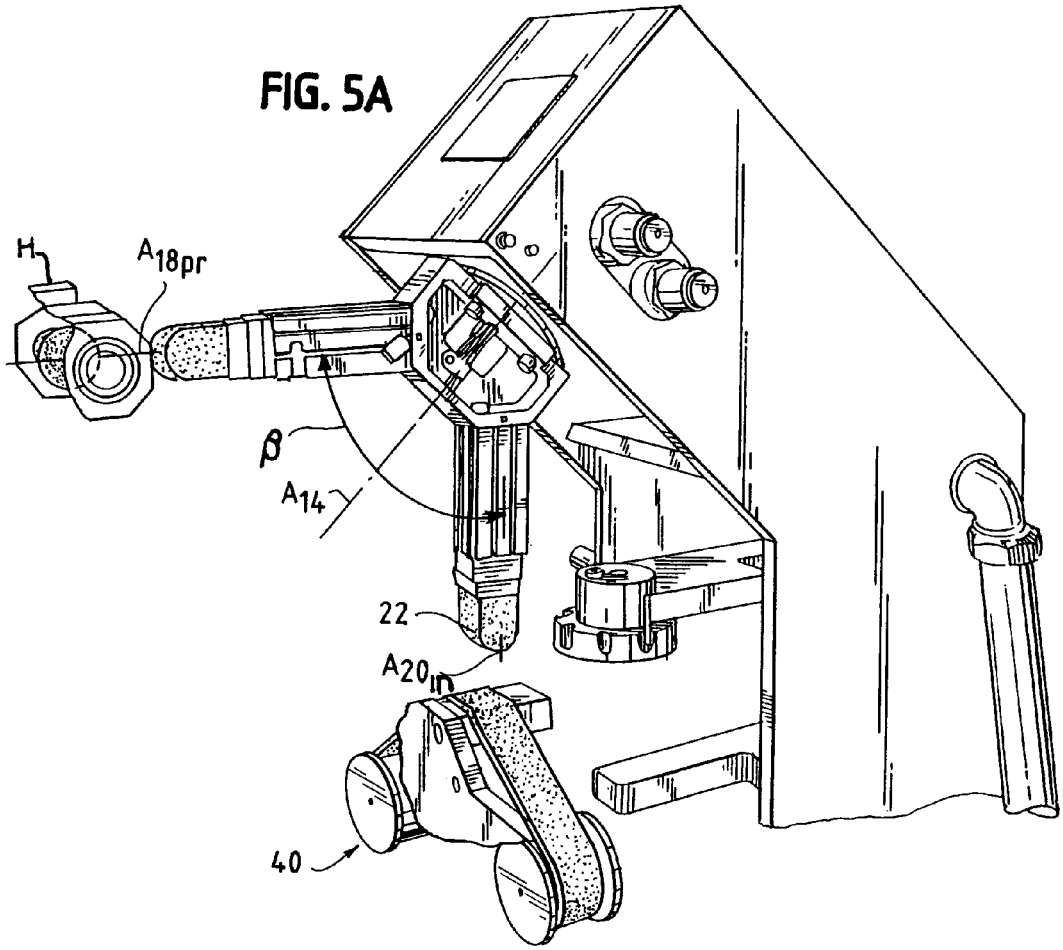
FIG. 5A is a perspective view of the printer illustrating the cleaning tape in position in place of the cliche plate with the pad positioned above the tape.
Figure 5B:
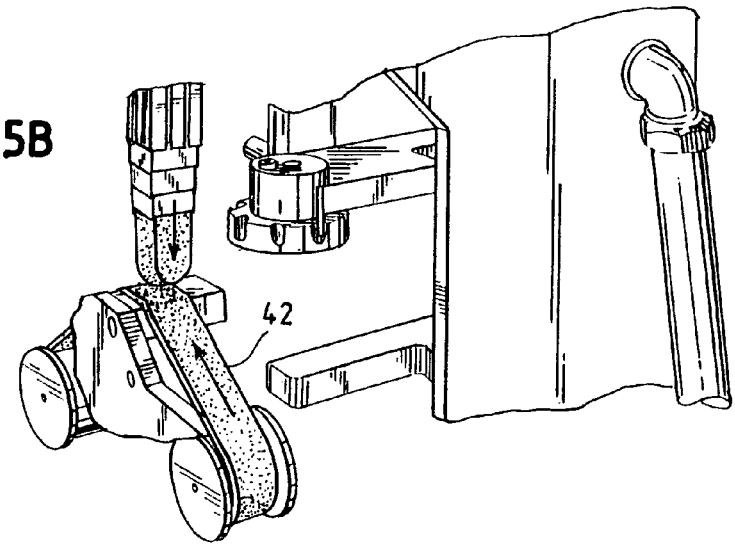
FIG. 5B illustrates the pad in contact with the cleaning tape.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be understood that the title of this section of this specification, namely, "Detailed Description Of The Invention", relates to a requirement of the United States Patent Office, and does not imply, nor should be inferred to limit the subject matter disclosed herein.

Referring now to the figures and briefly to FIG. 1A, there is shown a rotary head pad printer 10 embodying the principles of the present invention. The printer 10 is configured to print high quality indicia onto objects of various sizes and shapes. The printer 10 illustrated in FIG. 1A is shown with various pneumatic lines L mounted thereto that have been removed from the remaining figures for clarity of illustration.

Advantageously, the present printer 10 can be used to print onto objects having spherical, cylindrical or even irregular shapes, and that have irregular surfaces as well, as exemplified by the golf ball B which has a spherical shape and a dimpled surface. The operation and principles of conventional types of pad printers and the transfer of ink onto the pads and transfer from the pads to an object are described in Kleist, U.S. Pat. Nos. 5,694,847 and 5,476,040 and Wohl et al., U.S. Pat. No. 5,694,839, which patents are commonly assigned with the present application and are incorporated herein by reference.

The printer 10 includes a frame 12 having a rotating head or turret 14 mounted thereto. A drive 16 is operably connected to the turret 14 to effect rotational movement of the turret 14 about an axis $A_{14}$ (see FIG. 1D). Drives 16 that can be used for the turret 14 include direct drives, servomotors and like precision rotary drives. The printer includes at least one and preferably two pad assemblies 18, 20 mounted to the turret 14 for rotation with the turret 14. The present printer 10 includes two such assemblies 18, 20 to effect an increased cycle rate or throughput for the printer 10.

Each assembly 18, 20 includes a deformable printing pad or ink pad 22 onto which the ink is transferred and from which the ink is transferred to the object to be imprinted. A typical pad 22 is formed from a resilient, low permeability material such as silicone rubber or the like.

In the illustrated embodiment, the turret 14 is mounted to the frame 12 at an angle $\alpha$ such that the rotational axis $A_{14}$ of the turret forms an angle of about 45 degrees to the horizontal. It will, however, be appreciated by those skilled in the art that the angle $\alpha$ at which the turret axis $A_{14}$ lies relative to the horizontal can be any angle. The pad assemblies 18, 20 are mounted to the turret 14 at an angle $\beta$ relative to one another of about 90 degrees. The angle $\beta$ between the assemblies can be any angle between (but exclusive of) zero degrees and (inclusive of) 180 degrees.

Each assembly 18, 20 is mounted to the turret by a reciprocating drive element 24, such as the illustrated pad cylinder. The cylinder 24 drives the pad 22 to move the pad 22 between an extended position (in which the pad contacts the cliche plate or the object to be printed, e.g., the ball, the extended inking and extended printing positions indicated at 26 and 28, respectively), and a retracted position (similarly referred to as retracted inking and retracted printing positions indicated at 30 and 32, respectively). In a present printer 10, the cylinders 24 are pneumatically actuated cylinders to effect extension and retraction movement. Other types of drives for the cylinders 24 will be recognized by those skilled in the art.

In a present printer 10, the cylinders 24 can be actuated independently of one another and independently of the head drive 16. This provides enhanced flexibility in printing and facilitates increased printer machine 10 control and throughput. Actuation of the cylinders 24 can be controlled by a controller 34.

Turning to FIGS. 1C and 1D, the movement of the assemblies 18, 20 will now be described. Viewing first the movement of assembly 20, in which, as seen in FIG. 1C, the pad 22 moves in a first reciprocating, linear manner between the extended and retracted positions in the inking position. This movement defines an axis if, for example, a point is selected on the pad 22. That is, as the pad 22 reciprocates in the inking position, that point defines a first line or axis of linear movement $A_{20in}$. Likewise, when the assembly 20 is in the printing position (FIG. 1D), movement of that same point on the pad 22 defines a second line or axis of linear movement $A_{20pr}$ that is different from the first axis of movement $A_{20in}$. The extended printing and inking positions each define a target area (at the object B to be printed and at the cliche plate 36, respectively).

The axes $A_{20in}$, $A_{20pr}$ are related to one another in that they are defined by the same physical point on the pad 22 moving in a straight line motion (the first and second linear movements). The rotational movement from the inking position to the printing position (or the printing position to the inking position), as indicated by the double headed arrow at 44 (see FIG. 1D) defines a semicircle. The axes $A_{20in}$, $A_{20pr}$ as they rotate, define a conical section (a semi-conical section as defined by a longitudinal plane through the cone). In that the rotational movement of the assembly 20 is back-and-forth (see arrow 44), semicircles and semi-conical sections (rather than circles and cones) are defined.

The movement of the each of the assemblies 18, 20 is such that the linear movement axes $A_{20in}$, $A_{20pr}$ and $A_{18in}$, $A_{18pr}$ are non-parallel. That is, the axis $A_{20in}$ does not lie along the same line as and in the same direction as the axis $A_{20pr}$. The axes $A_{20in}$ and $A_{20pr}$ may lie along the same line, but in opposite directions from one another (180 degrees from one another) in which case the axes $A_{20in}$ and $A_{20pr}$ are considered to be anti-parallel due to the opposing directional nature of the movements.

The movement of assembly 18 likewise defines similar axes $A_{18in}$ and $A_{18pr}$ that define semi-circular and semi-conical sections. The assemblies 18, 20 (and the turret 14) rotate in a back-and-forth, semicircular manner to prevent tangling of pneumatic and electrical lines that might otherwise occur in a circular motion. Those skilled in the art will recognize that connection could be provided that permit full circular motion without connecting line tangling and that such connections are within the scope and spirit of the present invention.

It will also be appreciated that the rotational motion of the turret 14 (and thus the assemblies 18, 20) is through an angle $\gamma$ (FIG. 1D) of 180 degrees. In this manner, printing occurs at the same location (e.g., target area in space or at the object holder H) for each cycle of the printer 10 and re-inking likewise occurs at the same plate 36 location (or target area) for each cycle of the printer 10.

As set forth above, the mounting of the assemblies 18, 20 to the turret can be such that the assemblies 18, 20 are in opposing relation to one another. That is, the assemblies extend in directions that are 180 degrees to one another. In this configuration, the points on the pads 22 would define a semicircle as the assemblies 18, 20 rotate between the inking and printing positions.

Referring to FIGS. 1D and 4, the printer 10 includes (in addition to the turret or head 14, drive 16 and pad assemblies 18, 20) a cliché plate 36 (having the artwork in the form of an engraving that is etched or engraved therein) and an ink cup 38. The plate 36 and cup 38 reciprocate relative to one another to supply ink to the plate 36. In a present printer 10, the cliche plate 36 reciprocates relative to the ink cup 38. Movement of the cliché plate 36 can be controlled by the controller 34.

The printer 10 can also include a cleaning assembly 40, such as the illustrated cleaning tape system. A tape 42 travels along a path and into a position that the cliché plate 36 would otherwise occupy, and the pad 22 is brought into contact with the tape 42 after a predetermined number of printing cycles. This removes excess or built-up ink or residue from the pad 22. Actuation of the cleaning assembly 40 can also be controlled by the controller 34.

As will be appreciated by those skilled in the art, the present printer 10 permits a wide variety of product conveyance configurations that otherwise would not be possible with unidirectional printers. In that the ink supply (cup 38) and cliché plate 36 are generally maintained in a common horizontal plane, and the plate 36 is typically maintained horizontal, the present rotary head printer 10, having non-collinear, non-unidirectional cylinder 24 movements, permits the articles onto which ink is applied to lie in a plane different from that defined by the ink cup 38 and cliché plate 36. This permits conveyance configurations not previously known, in which the item to be imprinted is, for example, conveyed at a higher elevation than the cliché plate 36 and ink cup 38. The present printer 10 thus lends itself well in situations in which the object to be printed cannot be conveyed at the same elevation as the cliché plate 36, for example, where the object is conveyed above the elevation of the cliché plate 36.

All patents referred to herein, are incorporated herein by reference, whether or not specifically done so within the text of this disclosure.

In the disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A rotary head pad printer comprising:

a frame;

a head mounted to the frame for rotational movement on the frame, the head rotatable so as to define a plane; and two pad assemblies mounted to the head at an angle relative to one another between zero and 180 degrees, exclusive of zero degrees, each pad assembly reciprocating between an extended position and a retracted position, the pad assemblies being mounted to the head which is rotatable 180 degrees about an axis between a first rotational position and a second rotational position, wherein the assemblies reciprocate between the extended and retracted positions at the first and second rotational positions and wherein the first and second rotational positions are non-parallel to one another.

2. The rotary head printer in accordance with claim 1 wherein the assemblies are mounted to the head at an angle relative to one another of about 90 degrees.

3. The rotary head printer in accordance with claim 1 including a head drive for rotating the head.

4. The rotary head printer in accordance with claim 3 wherein the head drive is a servomotor.

5. The rotary head printer in accordance with claim 1 wherein the pad assembly includes a reciprocating cylinder.

6. The rotary head printer in accordance with claim 5 wherein the reciprocating cylinder is a pneumatic cylinder.

7. A rotary head pad printer comprising:

a frame;

a head mounted to the frame for rotational movement on the frame, the head rotatable so as to define a plane; and at least one pad assembly mounted to the head, the pad assembly reciprocating between an extended position and a retracted position, the pad assembly rotatable about an axis between a first rotational position and a second rotational position, wherein the assembly reciprocates between the extended and retracted positions at the first and second rotational positions and wherein the first and second rotational positions are non-parallel to one another, and wherein the plane defined by the head rotation is at an angle of about 45 degrees to the horizontal.

8. A rotary head pad printer comprising:

a frame;

a head mounted to the frame for rotational movement on the frame, the head rotatable so as to define a plane; and two pad assemblies mounted to the head, each pad assembly reciprocating between an extended position and a retracted position, the pad assemblies rotatable about an axis between a first rotational position and a second rotational position, wherein the assemblies reciprocate in a non-parallel manner relative to one another, between the extended and retracted positions at the first and second rotational positions and wherein the first and second rotational positions are non-parallel to one another, wherein the pad assemblies reciprocate independently of one another.

9. A rotary head pad printer comprising:

a frame;

a head movably mounted to the frame, the head being movable so as to define a plane;

a drive for moving the head; and first and second reciprocating pad assemblies mounted to the head, each of the pad assemblies reciprocating independently of the other between an extended position and a retracted position, wherein the head is rotatable to position the first pad assembly at an inking position when the second pad assembly is at a printing position and to rotate through a semicircular path to reverse the positions of the first and second pad assemblies, and wherein reciprocation of the pad assemblies is nonparallel relative to one another.

10. The rotary head printer in accordance with claim 9 wherein the first and second assemblies reciprocate relative to one another and form an angle of between but greater than about zero degrees and about 180 degrees.

11. The rotary head printer in accordance with claim 10 wherein the angle formed between the first and second assemblies is about 90 degrees.

12. The rotary head printer in accordance with claim 9 wherein the head rotational plane is at an angle of about 45 degrees to the horizontal.

13. The rotary head printer in accordance with claim 12 wherein the reciprocating cylinder are operable independent of the head drive.

14. The rotary head printer in accordance with claim 9 wherein each of the first and second pad assemblies includes a reciprocating cylinder.

15. The rotary head printer in accordance with claim 9 wherein the head rotates 180 degrees to move the pad assemblies between the inking and printing positions.

16. A rotary head pad printer comprising:

a frame;

a head rotatably mounted to the frame; and a pair of reciprocating pad assemblies carried by the head, each of the pad assemblies reciprocating independently of the other between an extended position and a retracted position, the head being positionable to orient a first pad assembly at a first position when a second pad assembly is at a second position and to rotate about 180 degrees to reorient the first pad assembly to lie at the second position when the second pad assembly lies at the first position, the pad assemblies reciprocating in respective first and second directions that are nonparallel to one another.

17. The rotary head printer in accordance with claim 16 wherein the first pad assembly in the first position extends to define a first target area and wherein the second pad assembly in the second position extends to define a second target area and wherein upon rotation of the head, the first pad assembly in the second position extends to the second target area and the second pad assembly in the first position extend to the first target area, the first and second assemblies extending in directions nonparallel to one another.

* * * * *